US006321514B1

(12) United States Patent
Thomsen

(10) Patent No.: US 6,321,514 B1
(45) Date of Patent: Nov. 27, 2001

(54) METHOD OF AND A DEVICE FOR COMPRESSED PACKAGING OF TREES AND GREENERY ON A PALLET OR THE LIKE WITH LATERAL SUPPORTS

(76) Inventor: Claus Thomsen, 4, Højvang, Aarup 5560 (DK)

( * ) Notice: Subject to any disclaimer, the term of this patent is extended or adjusted under 35 U.S.C. 154(b) by 0 days.

(21) Appl. No.: 09/381,886

(22) PCT Filed: Mar. 25, 1998

(86) PCT No.: PCT/DK98/00122

§ 371 Date: Nov. 23, 1999

§ 102(e) Date: Nov. 23, 1999

(87) PCT Pub. No.: WO98/42577

PCT Pub. Date: Oct. 1, 1998

(30) Foreign Application Priority Data

Mar. 26, 1997 (DK) ..... 0348/97

(51) Int. Cl.[7] ..... B65B 5/10; B65B 35/50

(52) U.S. Cl. ..... 53/475; 53/436; 53/447; 53/527; 53/541

(58) Field of Search ..... 53/399, 537, 475, 53/541, 244, 436, 449, 447, 527, 582, 540

(56) References Cited

U.S. PATENT DOCUMENTS

| | | | | |
|---|---|---|---|---|
| 2,720,055 | * | 10/1955 | Morris | 53/527 |
| 3,827,353 | | 8/1974 | Isberg . | |
| 4,619,193 | * | 10/1986 | Crew | 53/530 |
| 5,421,140 | * | 6/1995 | Theriault | 53/529 |
| 6,119,604 | * | 9/2000 | Thomsen | 108/55.1 |

FOREIGN PATENT DOCUMENTS

| | | |
|---|---|---|
| 169147 B1 | 3/1989 | (DK) . |
| 439/95 | 4/1995 | (DK) . |
| 96 00153 U3 | 6/1996 | (DK) . |
| 172068 B1 | 10/1997 | (DK) . |
| WO97/06065 | 2/1997 | (WO) . |
| WO 97/42085 | 11/1997 | (WO) . |

* cited by examiner

*Primary Examiner*—Peter Vo
*Assistant Examiner*—Louis K. Huynh
(74) *Attorney, Agent, or Firm*—Merchant & Gould P.C.

(57) ABSTRACT

A device for packing trees and greenery on a pallet or the like having lateral supports. The device comprises a base part capable of supporting a pallet and a working tower protruding upwards from one side of the base part. The working tower comprises a top part which is movable between a horizontal position and a vertical position, and which, at least in its horizontal position, is slidable in a vertical direction to compress the trees packed on the pallet. The device additionally comprises a frame which at least comprises plate parts at the ends of the pallet, and which together with the lateral supports of the pallet defines a delimited loading area for trees and greenery. The frame is vertically slidable, and the top part has an extent in its horizontal position which cause trees and greenery as well as the frame to be pressed downwards by the top part during the compression. Also described is a method of compressed packing of trees and greenery on a pallet or the like having lateral supports.

11 Claims, 3 Drawing Sheets

METHOD OF AND A DEVICE FOR COMPRESSED PACKAGING OF TREES AND GREENERY ON A PALLET OR THE LIKE WITH LATERAL SUPPORTS

TECHNICAL FIELD

The invention relates to a method of and a device for compressed packing of trees and greenery on a pallet or the like with lateral supports.

BACKGROUND OF THE INVENTION

Today, it is generally known to pack e.g. Christmas trees on pallets, and it is also known to compress these Christmas trees so that the pallets can contain more trees than if the trees are in their uncompressed state. The compression takes place in that the trees on the packed pallet are subjected to a pressure vertically and/or horizontally, thereby causing compression of the trees. The trees are tied while the pressure is maintained, and then the pallet with the compressed trees is ready for further distribution.

Various devices for compressed packing of particularly Christmas trees on pallets are known, which devices operate according to different principles.

The devices may be divided into two groups, viz. devices wherein packing is carried on pallets which in themselves are not provided with lateral supports, and wherein tying of the packed material is performed, e.g. so-called Europallets, and devices wherein packing is carried out on pallets which in themselves are provided with lateral supports protruding upwards from the pallet, and wherein no tying of the packed material is performed.

When Christmas trees are packed on pallets without lateral supports, the packed and compressed trees are secured by laths which are positioned such that, together with the pallet, they form a frame at each end of the pallet, following which the two frames are separately tied with a steel or plastics band.

A device for performing such a packing of pallets without lateral supports is known from e.g. Danish Utility Model No. 96 00153, which shows a device for mounting on the lifters of a tractor and having a top part which is movable between a vertical position and a horizontal position, and which is capable of performing vertical compression of the packed tress in the horizontal position.

However, tying with steel or plastics band around frames of laths has a number of drawbacks, such as for example:

- special holders are required for securing the laths with respect to the pallet immediately before the steel or plastics band is tied,
- special tools are required for closing the steel or plastics band to achieve the necessary tightening of the band, it is not possible to perform selective unloading, because all the trees are loosened at the same time when the steel or plastics band is cut, which also requires special tools,
- danger of personal injury when the steel or plastics bands are cut, as these exhibit a whipping effect when they are loosened,
- the tied steel or plastics band gives an increased amount of waste, and is moreover difficult to handle when it is to be disposed of.

Because of these drawbacks and for other reasons, other pallets have been developed for the packing of e.g. Christmas trees, said pallets being provided with lateral supports.

Danish Patent No. 169 147 discloses a pallet system which consists of a relatively fragile pallet, a so-called export pallet, which is provided with lateral supports. When being packed with trees, the export pallet is supported by a more rigid and stronger pallet, a so-called forest pallet. After packing, the trees are compressed on the pallet in that a fork assembly mounted on a tractor is pressed down on the trees, and then the opposite lateral supports of the export pallet are connected by chains. The export pallet with the packed trees may then be removed from the forest pallet and e.g. be loaded on a truck for further distribution.

The said export pallet has a size of 2×2.4 $m^2$, which means that the packed pallets are so heavy that relatively strong equipment has to be used for loading and unloading. The size also means that a packed pallet of this type may be stable without the use of lateral supports.

To overcome the handling problems of the relatively large export pallet smaller and lighter pallets have been developed, e.g., as shown in Danish Patent No. 172 068, which discloses a pallet having lateral supports which is likewise of a relatively fragile structure, and in which the opposite lateral supports are also connected during the packing with trees.

The advantages of using a pallet having lateral supports include:

- the pallet is already provided with the necessary supports which are merely connected by strings or the like,
- it is possible to perform selective unloading, as the trees may be removed from the top of the loaded pallet after the uppermost strings or the like between opposite lateral supports have been removed,
- it is possible to unload individual trees and optionally supplement with new ones for further distribution,
- if the lateral supports are removable, all the trees may be removed from the pallet at the same time, if desired, by removing all the lateral supports,
- if the lateral supports are removable, the trees may be unloaded from one side merely by removing the lateral supports on one side of the pallet,
- there is less danger of personal injury, as there are no steel or plastics bands which have to be cut,
- if the pallet is arranged as stated in Danish Patent No. 172 068, both pallet and lateral supports as well as strings or the like may be returned, which means that there will be no waste.

A general problem of the packing of trees and decorative greenery is that sliding of material takes place during loading and compression, so that it is difficult to keep the ends of the packed trees and decorative greenery within the permissible boundaries, which are defined e.g. by the internal dimensions of a truck. Sliding occurs in particular at the moment when the trees are placed on the pallet, which frequently takes place by throwing the trees on to the pallet, which subjects the underlying trees to pressure impacts. Sliding is difficult to control and therefore causes the pallet to have a very nonuniform face in the areas—typically the ends—where there is no control of the trees.

If the trees and the decorative greenery protrude beyond the permissible boundaries, the pallet cannot be loaded on a truck, and at worst the whole pallet has to be repacked. To avoid this, the pallets are frequently packed more narrowly than necessary, whereby the capacity of the truck is not utilized optimally.

In addition to packing Christmas trees on pallets, it is also known to pack Christmas trees in a sack, cf. Danish Patent Application No. 0439/95. The sack is kept distended during filling by means of a stationary frame which holds the sides of the sack. When the sack is full, the trees are compressed in that annular straps pull the sides of the sack toward each other, following which these are coupled together by means of double hooks.

This form of packing Christmas trees, however, have some of the same drawbacks as are mentioned above. For example, a sack indeed reduces sliding during loading, but since the sack consists of a flexible material, sliding will still take place. Sliding and the flexible material of the sack also mean that a packed sack will always bulge in all directions, and as a consequence of this the sacks cannot be stacked optimally, either at the side of each other or on top of each other. In addition, a packed sack must be handled by means of a crane, both during handling in the forest and during loading on and unloading from a truck.

SUMMARY OF THE INVENTION

The object of the present invention is to provide a method of and a device for compressed packing of trees and greenery on a pallet or the like which solve the above-mentioned problems.

The present invention is directed to a method of compressed packing of trees and greenery on a pallet or the like that has lateral supports, the method including steps of placing the pallet having lateral supports with its loading face facing upwards. A vertically slidable frame which at least includes plate parts at the ends of the pallet, is placed around the pallet and thus defines together with the lateral supports a delimited loading area. Trees and greenery are loaded in extension of the loading face of the pallet and are then compressed in a vertical direction. During loading, the frame is raised as the pallet is loaded, so that loading always takes place within the frame, and so that the lowermost part of the frame still supports the upper ones of the trees and greenery loaded prior to the raising. Then, opposite lateral supports of the pallet are connected by a string or the like.

The frame is moved up over the loaded trees and greenery after the last compression has been performed and the lateral supports have been connected by a string or the like. The loaded pallet may then be removed.

The use of the method described herein ensures that a pallet may be packed more optimally, it being possible by using said frame to control the lateral displacement of trees and greenery, which will always occur when trees and greenery are packed without using lateral plates. Thus, the use of the frame enables control of the sliding of trees during packing when these are loaded on the pallet. The weight of the trees moreover causes pre-compression of the packed material, whereby each of the trees finds its own position in which they "lock" together, so that no further sliding takes place. This mutual locking of the trees is enhanced in the following mechanical compression, following which it is quite exceptional that further sliding during packing takes place.

The use of a frame ensures that the trees and the greenery are kept within the boundaries of the frame during packing, and it has been found that the pre-compression caused by the weight of the packed material within the frame "binds" the trees and the greenery so well together that only a very minimal sliding takes place subsequently when the frame is lifted and no longer supports the trees and the greenery.

In particular, the repeated compression of the trees is stressed, as this repeated compression causes the pallet to be packed more closely than is possible if the trees are compressed only once. Preferably, the frame is moved downwards during compression. The frame can be raised each time the loaded trees and greenery reach the upper edge of the frame. The packed pallet can be compressed several times during loading, and the opposite lateral supports can be connected by strings or the like after the compression.

It is preferred that when the frame is raised to its uppermost loading position, the lowermost edge of the frame supports the uppermost part of the lateral supports, and that the frame is then filled with trees and greenery to the upper edge of the frame, following which the pallet is compressed in order to make the trees and greenery flush with the upper ends of the lateral supports.

The device for packing trees or greenery on a pallet is arranged precisely such that the above-mentioned advantages can be achieved by it.

As stated, the frame need only comprise plate parts at the ends of the pallet, but preferably it is constructed as a closed frame which encloses the pallet on all sides and supports the upwardly extending lateral supports of the pallet.

Trees and greenery as well as the frame is pressed downwards when the top part is moved downwards to compress the packed material. Since, as mentioned, the material below the frame may have slide somewhat or side branches or other "loose" material protrude beyond the lowermost edges of the frame, the frame may advantageously be provided with obliquely outwardly extending guide faces at its outermost edges. Material that may possibly have slid will hereby be guided into the frame again during the compression.

The pallets with lateral supports which are contemplated for use in the stated device, have a relatively fragile structure, and therefore the frame may advantageously support the lateral supports of the pallet against deflection while it is being loaded.

Preferably, the frame is arranged such that it may be adjusted in length and in width and thus be adapted to various pallet sizes or various dimensions of the packed pallet. The frame may optionally be removable so that it may be replaced by a frame of other dimensions.

When the device according to the invention is used, a person will normally be present within the frame, that is on the pallet when this is empty and later on the packed material. This person sees to it that the trees and the greenery, which are loaded by another person outside the frame, are placed optimally so that the pallet is packed optimally. For reasons of safety, the frame may therefore be provided with a railing toward the side which faces away from the working tower.

To increase the mobility of the device, it may advantageously be adapted for mounting on the lifters of a tractor or a similar working implement, and when the base part is constructed as a separate unit with forks displaceable vertically with respect to the working tower, it is ensured that the device may be used directly as a loading machine for the handling - including stacking and placing on a truck platform - of empty as well as packed pallets.

If the length of the forks is considerably greater than the width of an ordinary pallet, the forks may be used more flexibly for the transport of e.g. empty pallets, and the additional space may moreover be used as a reception area for trees and greenery which do not fit the pallet concerned.

BRIEF DESCRIPTION OF THE FIGURES

The invention will now be explained more fully below with reference to the drawing, in which.

DETAILED DESCRIPTION

Figure 1:
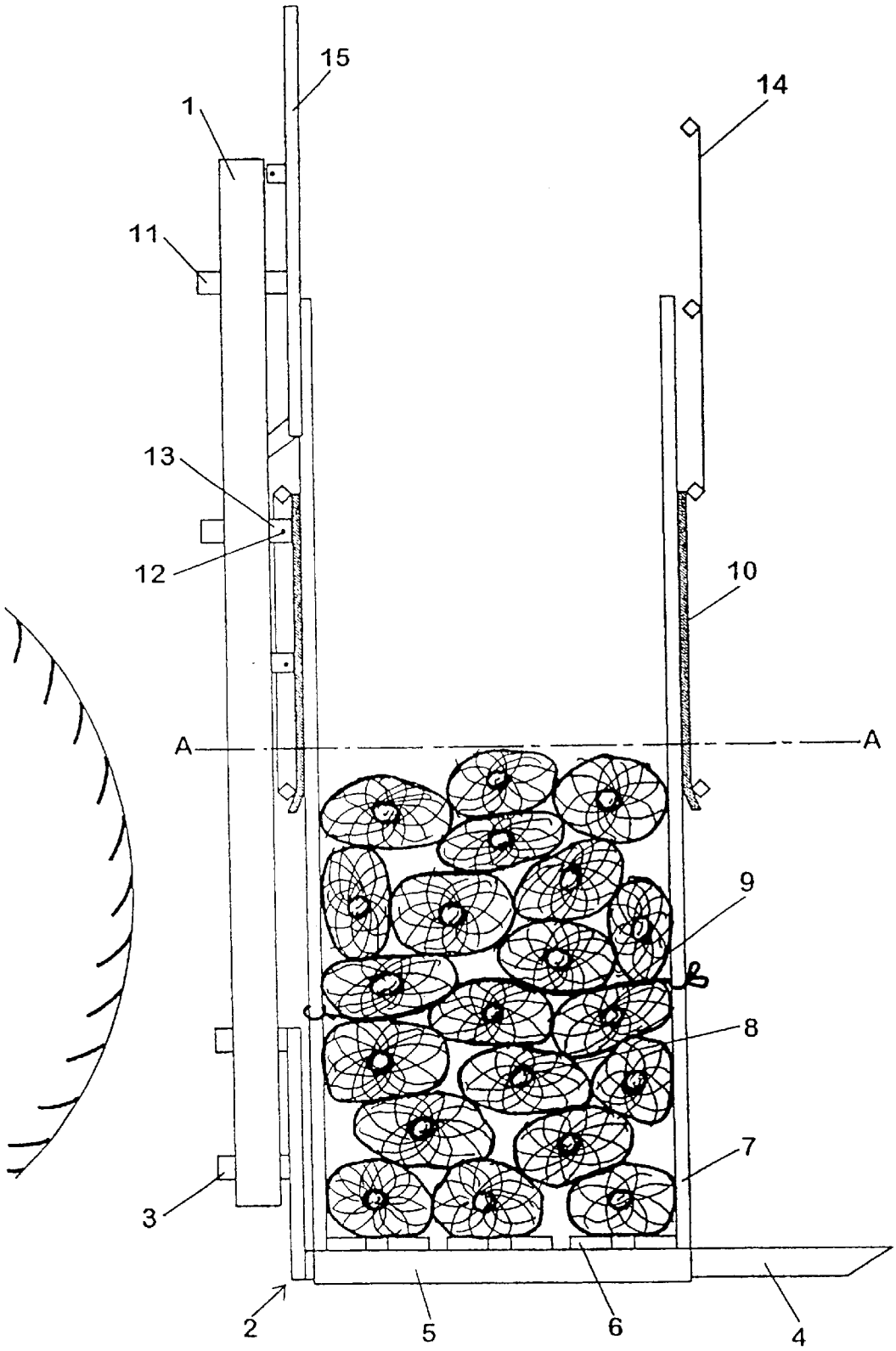
FIG. 1 shows a basic sketch of an embodiment of the invention seen from the side in the section B—B in FIG. 2.

FIG. 1 shows the device for compressed packing of trees and greenery according to the invention seen from the side and particularly in section. The device comprises a working tower 1 which is adapted to be mounted on the lifters of a tractor or a similar working implement, which, however, is not shown in detail, because a skilled person can easily device a suitable bracket for this. The rear wheel of a tractor is indicated to the left in FIG. 1.

Figure 2:
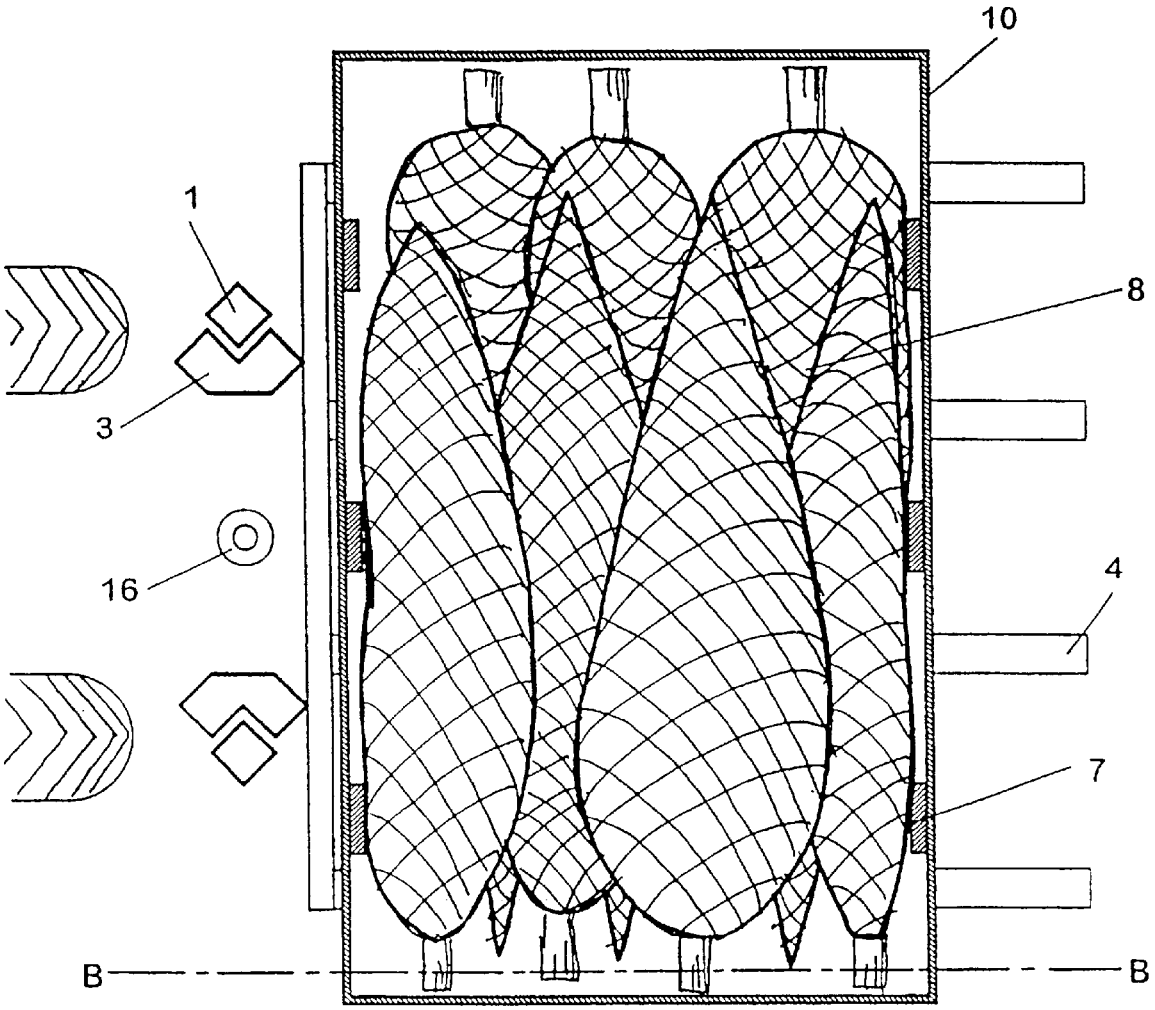
FIG. 2 shows a basic sketch corresponding to FIG. 1, but seen from above in the section A—A in FIG. 1.

The working tower 1 is the load-bearing unit of the device as it carries all the other units of the device. Downwardly is the base part 2 consisting of a part 3 which is vertically slidable on the working tower 1, and on which a downwardly extending part with lifting forks 4 is mounted. Preferably, four lifting forks 4 are mounted transversely to the device, as shown in FIG. 2, but, of course, this number may be varied, as needed.

As mentioned, the lifting forks 4 may be moved vertically by means of the slidable part 3, and these may therefore operate like the lifting forks of a truck, so that the device may be used as a loading machine, e.g. in the loading of a truck with packed pallets.

A pallet 5 having a loading face 6 and lateral supports 7 is arranged on the lifting forks 4. The pallet is approximately half-loaded with trees 8, which will typically be wrapped in a nylon net before they are loaded on the pallet 5. In other known systems it is a requirement that the trees are wrapped in a nylon net to prevent protruding branches from being damaged during handling, but this is not necessary with the use of a device according to the invention, particularly not when a completely closed frame is used, as shown in FIG. 2.

The opposite lateral supports 7 of the pallet 5 have been connected by strings 9 during the loading operation to prevent deflection of the lateral supports 7. The strings 9 moreover have the effect that they ensure the stability of the packet pallet to a considerable extent as they "wind" between the trees 8 and hereby additionally pull the lateral supports inwards.

A frame 10 is shown in section at the upper end of the lateral supports 7, and this frame extends all the way round the pallet 5 and its lateral supports 7. The size of the frame 10 depends on which type of trees or greenery is to be packed and on which type of pallet is used. Preferably, the same frame 10 may be adjusted for various sizes, but this is not of importance to the invention as such and will not be described more fully.

The frame 10 is mounted in a part 11 which is vertically slidable in the working tower 1, and the frame 10 may thus be moved up and down with respect to the working tower 1 and with respect to the pallet 5 with lateral supports 7. The frame 10 is mounted in the slidable part 11 at the points 12 on the arms 13 and can thus be removed when the device is to be used as a loading device, or if it is to be replaced by another frame.

The lowermost edges of the frame 10 extend obliquely outwards, as shown, which is of importance during the compression of the packed material, as will be discussed later.

A railing 14, whose function will also be discussed later, is mounted on the upper edge of the frame 10 to the right in FIG. 1.

Figure 3:
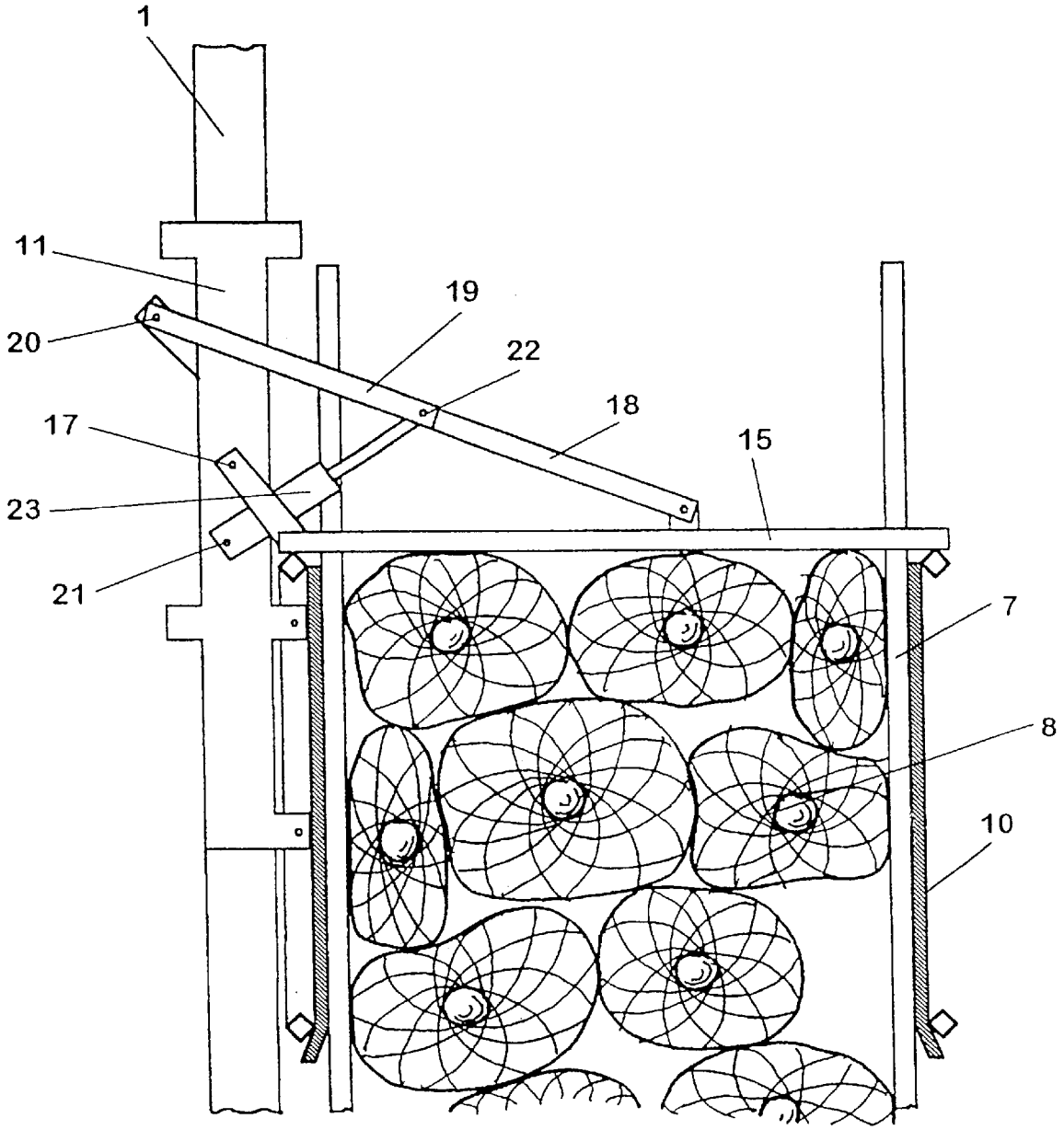
FIG. 3 is a detailed view of the cooperation of the top part with the frame during compression seen from the side.

The slidable part 11 is additionally provided with a pivotally mounted top part 15 above the frame 10, said top part being shown in its vertical position in FIG. 1. The top part preferably consists of rods which together provide a railing of a certain strength. The top part 15 may be pivoted from the shown vertical position to a horizontal position, as shown in FIG. 3, by drive means not shown in detail in FIG. 1.

FIG. 2 schematically shows the device for compressed packing of trees and greenery from above in the section A—A in FIG. 1.

It will be seen in FIG. 2 that the working tower 1 comprises two quadrangular pipe profiles, and that the slidable part 3, which carries the base part 2 with the lifting forks 4, is provided with a slide guide with respect to the quadrangular pipe profiles of the working tower 1. The slidable part 11, which carries the frame 10 and the top part 11, may be arranged in the same manner.

The frame 10 is shown as a closed frame which completely encloses the pallet 5 and the trees 8 loaded on it. It will likewise be seen that the frame 10 engages the lateral supports 7 of the pallet and thereby support these against deflection, while the pallet is being loaded with trees 8. In the shown schematic view the frame 10 engages the lateral supports 7 directly, while, in practice, rollers or another form of slide guide may be used for ensuring the engagement between the frame 10 and the lateral supports 7. The frame 10 may also be arranged with plate parts which are moved between the lateral supports

7. Preferably, the frame 10 is also provided with means which guide the lateral supports 7 laterally, which, however, is not essential to the principle of the invention.

Movement of the slidable parts 3 and 11 of the device preferably takes place by means of hydraulic cylinders 16 disposed between the vertical profile pipes of the working tower 1, as indicated in FIG. 2.

FIG. 3 shows an enlarged view of the top part 15 and its mechanism for movement from vertical to horizontal position.

As will appear, the top part 15 engages both the front edge and the rear edge of the frame 10, which is preferably reinforced on the uppermost edge when it assumes its horizontal position, which is of essential importance during the compression, as will be described later.

The top part 15 is pivotally connected with the slidable part 11 at the point 17 and via a toggle mechanism, which is formed by the arms 18 and 19, at the point 20. A double-acting hydraulic cylinder 23 is arranged between the point 21 and the toggle 22, said cylinder being in its extended position in the shown position. When the top part 15 is to be pivoted to a vertical position, the cylinder 23 is activated, whereby the toggle 22 is pulled downwards, which causes the top part 15 to be pivoted up to the vertical position, as shown in FIG. 1.

The use of the device according to the invention will be described more fully below.

The base part 2 is moved to a bottom position with respect to the working tower 1, and the top part 15 is pivoted to the vertical position. Then a pallet 5 is placed on the lifting forks 4, and the frame 10 is moved as far down as possible. Preferably, the frame 10 cannot be moved right down to the pallet 5 in order to avoid wedging between the frame 10 and the pallet 5.

Then the loading of trees 8 can begin, which takes place in that a person places himself within the frame 10 and receives and puts the trees 8 on the pallet from a person outside the frame 10. The railing 14 on the frame 10 ensures that the person within the frame 10 cannot fall out this way, and the working tower has the same effect on the opposite side. There is no railing at the short sides of the frame 10, as the loading of trees 8 takes place there.

When the frame 10 has been filled, the slidable part 11 is activated, whereby the frame 10 is moved so far upwards that it still supports the uppermost ones of the already packed trees 8.

The weight of the trees 8 has compressed the packed trees 8 so much already at this time that sliding below the frame 10 now raised is prevented.

The frame 10 is filled again, and then the person standing on the loaded trees 8 either steps aside or perhaps climbs down from the device.

The mechanical compression of the trees 8 is now performed in that the top part 15 is first brought to a horizontal position by activation of the cylinder 23, so that the top part engages the front and rear upper edges of the frame 10. Then the slidable part 11 is activated downwards, whereby the upper part and the frame are moved downwards and the trees 8 are compressed. The upper edges of the frame 10 are reinforced with profile pipes, as shown, since these must be capable of absorbing the depression force from the top part 15. When the top part 15 is allowed to engage both the front and rear edges of the frame 10, it is ensured that the depression force on the frame 10 is mainly transferred from the top part 15 and less from the mounting of the frame 10 on the slidable part 11.

While the trees 8 are compressed, a string 9 is tied between the opposite lateral supports 7 of the pallet 5. The string 9 is preferably tied loosely around the lateral supports 7 to allow movement up and down the lateral supports 7 because of further loading and further compression.

Since the lowermost edges of the frame 10 are provided with obliquely outwardly extending guide faces, any trees 8 or other material which has been pressed slightly outwards will be guided back within the frame 10.

When the trees have been compressed, the downwardly directed pressure is removed in that the slidable part 11 with the top part 15 and the frame 10 are raised until the top part 15 substantially no longer applies any downward pressure to the trees. Only then is the top part 15 pivoted from its horizontal to its vertical position.

The frame 10 is now displaced again a distance upwards, and loading of trees 8 can begin again.

The procedure is repeated until the pallet 5 is filled. The last loading takes place when the frame 10 has been raised to its uppermost loading position in which the lowermost edge of the frame 10 supports the uppermost part of the lateral supports 7. The frame 10 is then filled with trees 8 and greenery to the upper edge of the frame 10, following which the pallet is compressed a last time to make trees 8 and greenery flush with the upper ends of the lateral supports 7. The upper ends of the opposite lateral supports 7 are then connected by strings.

The frame 10 is then raised up over the lateral supports 7 of the pallet 5, so that the packed and compressed pallet 5 may be put down on the ground or be loaded on a truck by means of the lifting forks 4.

Then the entire packing procedure may be repeated again with a new pallet 5 with lateral supports 7.

The number of compressions may of course be varied depending on the material which is packed and on how close the pallet is to be packed. Also the tying of opposite lateral supports may be performed as frequently as is desired.

The invention has been described with reference to the schematic views in FIGS. 1–3, which show the principle of the invention. A skilled person can easily devise means for operating a device as described, and these are therefore not included in the present description.

In the embodiment shown, the frame 10 completely encloses the pallet to the packed. As mentioned before, this is not a requirement of the invention as such, since a partial enclosure may be sufficient. Thus, the lateral supports of the pallet and optionally the working tower may support the packed material on two of the sides.

What is claimed is:

1. A method of compressed packing of trees and greenery on a pallet that has lateral supports, the method comprising steps of:

providing a pallet having lateral supports and a loading face and placing the pallet with its loading face facing upwards;

placing a vertically slidable frame around the pallet, the vertically slidable frame and the lateral supports of the pallet defining a delimited loading area, the vertically slidable frame comprising plate parts arranged at ends of the pallet;

loading trees and greenery on the loading face of the pallet;

raising the frame as the pallet is loaded, so that loading always takes place within the frame, and so that a lowermost part of the frame still supports upper ones of the trees and greenery that were loaded prior to raising the frame;

compressing the trees and greenery in a vertical direction; and connecting opposite lateral supports of the pallet with string.

2. The method of claim 1, wherein the step of compressing the trees and greenery comprises moving the frame in a downwards direction.

3. The method of claim 1, wherein the step of raising the frame comprises raising the frame each time the loaded trees and greenery reach an upper edge of the frame.

4. The method of claim 1, wherein the step of compressing the trees and greenery comprises compressing the trees and greenery several times.

5. The method of claim 1, wherein when the frame is raised to an uppermost loading position, a lowermost part of the frame supports an uppermost part of the lateral supports, and the frame is then filled with trees and greenery to an upper edge of the frame, followed by compressing the pallet to make the trees and greenery flush with upper ends of the lateral supports.

6. The method of claim 1, further comprising steps of raising the frame up over the loaded trees and greenery after a last compression is performed and the lateral supports have been connected by strings and then removing the pallet.

7. A device for packing trees and greenery on a pallet having lateral supports, the device comprising:

a base part capable of supporting a pallet;

a working tower protruding upwards from one side of the base part, the working tower comprising a top part that is movable between a horizontal position and a vertical position and that, at least in its horizontal position, is slidable in a vertical direction to compress the trees packed on the pallet; and a frame which comprises plate parts arranged at ends of the pallet and which, together with lateral supports of the pallet define a delimited loading areas for trees and greenery;

wherein the frame is adapted to be vertically slidable, and that the top part of the working tower, when in its horizontal position, has an extent that causes trees and greenery as well as the frame to be pressed downwards during compression.

8. The device of claim 7, wherein the frame has a shape of a closed frame that encloses the pallet on all sides and that supports its upwardly extending lateral supports.

9. The device of claim 7, wherein the frame comprises obliquely outwardly extending guide faces positioned at lowermost edges of the frame.

10. The device of claim 7, wherein the frame is arranged to support lateral supports of the pallet against deflection while the pallet is being loaded.

11. The device of claim 7, wherein the frame is detachable from the device and can thus be replaced with a frame having a different size.

* * * * *